United States Patent [19]

Schultz et al.

[11] 4,432,169

[45] Feb. 21, 1984

[54] GLASS WARE ETCHING APPARATUS

[75] Inventors: James R. Schultz, Akron; Francis E. Smith, South Russell; Ralph J. Jurecki, Cleveland, all of Ohio

[73] Assignee: Cole National Corporation, Cleveland, Ohio

[21] Appl. No.: 264,034

[22] Filed: May 15, 1981

[51] Int. Cl.[3] ..... B24C 3/04; B24C 5/04; B24C 9/00

[52] U.S. Cl. ..... 51/424; 51/436; 51/439; 51/310

[58] Field of Search ..... 51/424, 262 R, 310, 51/428, 436, 412, 417, 263, 439

[56] References Cited

U.S. PATENT DOCUMENTS

| | | | |
|---|---|---|---|
| 1,016,415 | 2/1912 | Jorn, Jr. | 51/428 |
| 1,125,232 | 1/1915 | Weyl | 51/410 |
| 2,277,911 | 3/1942 | Johnson | 51/412 |
| 2,299,405 | 10/1942 | Prange | 51/310 |
| 2,458,825 | 1/1949 | Battey | 51/412 |
| 2,521,782 | 9/1950 | Escher | 51/417 |
| 2,846,821 | 8/1958 | Persak, Jr. | 51/412 |
| 3,044,218 | 7/1962 | Munn | 51/310 |
| 3,295,263 | 1/1967 | Savoca et al. | 51/262 R |
| 3,545,996 | 12/1970 | Duncan | 51/424 |
| 3,913,273 | 10/1975 | Romanowicz, Jr. | 51/412 |
| 4,028,851 | 6/1977 | Fricke | 51/424 |
| 4,266,378 | 5/1981 | Johnson | 51/310 |

FOREIGN PATENT DOCUMENTS

| | | | |
|---|---|---|---|
| 68242 | of 1893 | Fed. Rep. of Germany | 51/424 |
| 399932 | 10/1933 | United Kingdom | 51/412 |

*Primary Examiner*—Frederick R. Schmidt
*Assistant Examiner*—Robert A. Rose
*Attorney, Agent, or Firm*—Fay & Sharpe

[57] ABSTRACT

The glassware etching apparatus etches glassware or other workpieces with abrasive grit which is entrained in an air flow. The etching apparatus includes a cabinet having a work surface, a transparent shield over the work surface and upper and lower supporting shelves below the work surface. A foamed plastic workholder for receiving the workpiece to be etched is mounted on the work surface. A venturi structure for entraining abrasive grit in the air flow is mounted in alignment with the workholder on the upper shelf. A linear tube extending from the venturi structure directs the air flow with entrained grit toward the workholder. The air flow is generated by vacuum cleaner-type motor-impellers in fluid connection with the venturi structure. Grit rebounding from the workpiece is trapped by a fabric filter which extends from the bottom of the work surface around the directing tube. A tapered element is connected with the bottom of the filter and the venturi structure for channelling the collected grit back to the venturi structure for reentrainment.

15 Claims, 5 Drawing Figures

GLASS WARE ETCHING APPARATUS

BACKGROUND OF THE INVENTION

This application pertains to the art of abrading and more particularly, to the art of abrasive etching. The invention finds particular application in decoratively etching glass products and will be described with particular reference thereto. It will be appreciated, however, that the invention has broader applications including performing operations such as etching, polishing or the like on objects constructed of metal, plastic, wood, ceramic, or the like.

Today, there are retail stores which sell a variety of glassware items such as glasses, ashtrays, and the like. Many customers prefer glassware which is personalized with etched monograms or designs. Heretofore, the etching procedure has been too complex and time consuming to be performed by many of the retail stores. Rather, the glassware has been sent to specialists who have the appropriate equipment and skill. Industrial abrading apparatus which perform well under a wide range of conditions, on a wide range of workpieces, and with a wide range of abrasive grits, can be utilized to etch consumer glassware items. However, the cost of purchasing and maintaining these industrial abrading machines and the cost of training an operator render them economically infeasible for most retail establishments.

The present invention overcomes the above-referenced problems and others, yet provides a new and improved abrading apparatus which is ideally suited for etching glassware in retail stores. It is relatively inexpensive to purchase and maintain and is sufficiently simple that it can be operated by sales help without special training.

SUMMARY OF THE INVENTION

In accordance with the present invention, there is provided an abrading apparatus which comprises a workholder for holding a workpiece to be abraded, entraining means for entraining abrasive grit in a flow of air, air flow supplying means for supplying the flow of air to the entraining means, and grit collecting means for collecting grit rebounding from the workpiece. The entraining means includes a directing means for directing the air flow with entrained grit. The directing means is aligned with an aperture in the workholder such that the abrasive grit impinges directly on the held workpiece.

A primary advantage of the present invention is that it provides an abrasive etching machine suitable for use in retail establishments.

The present invention is also advantageous in that it provides an apparatus for etching glassware quickly and easily. It is readily operable by an untrained retail employee to etch glassware while the customer waits.

The present invention is further advantageous in that the machine is relatively inexpensive to purchase and maintain. The machine requires no fine tuning or adjustment.

Still other advantages of the present invention, such as its low noise, compact size, and the like, will become apparent to others upon reading and understanding the following description of the preferred embodiment.

BRIEF DESCRIPTION OF THE DRAWINGS

The invention may take form in various parts and arrangements of parts. The figures, which illustrate a preferred embodiment only, are not to be construed as limiting the invention, and are briefly described as follows.

DETAILED DESCRIPTION OF THE PREFERRED EMBODIMENT

Figure 1:
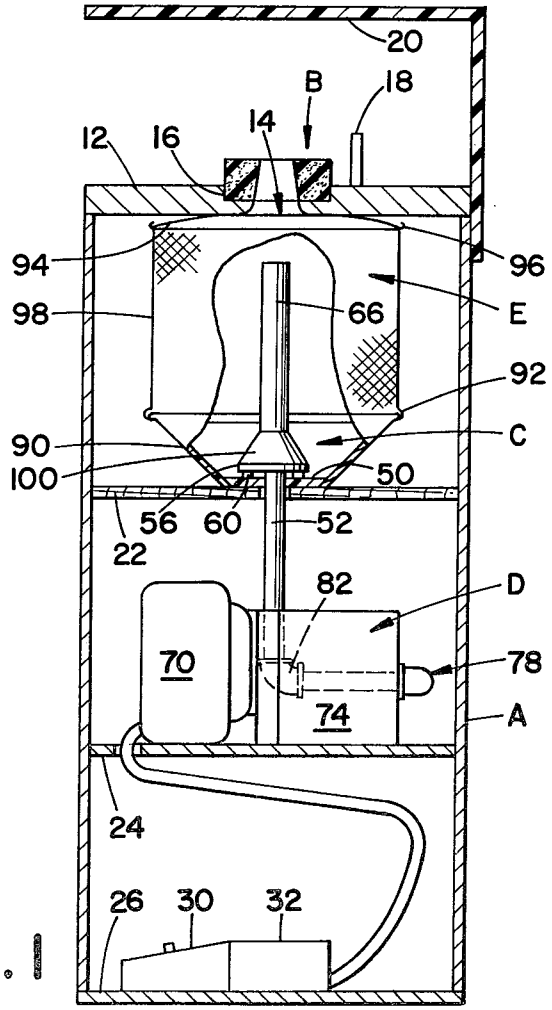
FIG. 1 is a side elevational view in partial section of an abrading apparatus in accordance with the present invention.

With reference to FIG. 1, the abrading apparatus is housed in a frame or cabinet structure A. Disposed on the cabinet at a convenient height is a workholder B for holding a workpiece to be abraded. The workpiece is abraded by abrasive grit which is entrained in a flow of air by a grit entraining means C and directed toward the workholder B. The air flow is supplied to the grit entraining means by an air flow supplying means D. After striking the workpiece, rebounding grit is collected by a grit collecting means E and returned to the grit entraining means C to be reentrained.

The cabinet A has a substantially horizontal work surface 12 disposed at a convenient working height for the operator, generally about 3½ feet from the ground. In the work surface 12 around an aperture 14, an area 16 is cutout or recessed for receiving the workholder B. Disposed adjacent the workholder is an adjustable guide means 18 for assisting the operator in positioning a workpiece accurately on the workholder. Various other positioning and aligning assists, not shown, such as measuring guides, grids, and the like may be disposed in conjunction with the work surface 12.

In normal operation, a workpiece is positioned accurately on the workholder B with the area to be etched over the work surface aperture 14. The workpiece closes the work surface aperture preventing abrasive grit from being thrown into the atmosphere. To protect the operator, particularly the operator's eyes, from inadvertent discharge of abrasive grit through the work surface aperture, a transparent shield 20 is disposed above the work. The shield 20, such as an L-shaped piece constructed of PLEXIGLAS acrylic resin sheets, permits the operator easy access from the front, as well as the left and right sides.

Disposed below the work surface 12 is an upper supporting means or shelf 22 for supporting the entraining means C and the grit collecting means E. A lower supporting means or shelf 24 disposed below the upper supporting shelf supports the air flow supplying means D. The cabinet A rests on a bottom wall 26 on which is disposed a foot switch 30 to be depressed by the operator to actuate the abrading apparatus. Optionally, a timer 32 may be connected with the foot switch to control the duration of each actuation to assure that an inexperienced operator will produce a quality etch.

Figure 2:
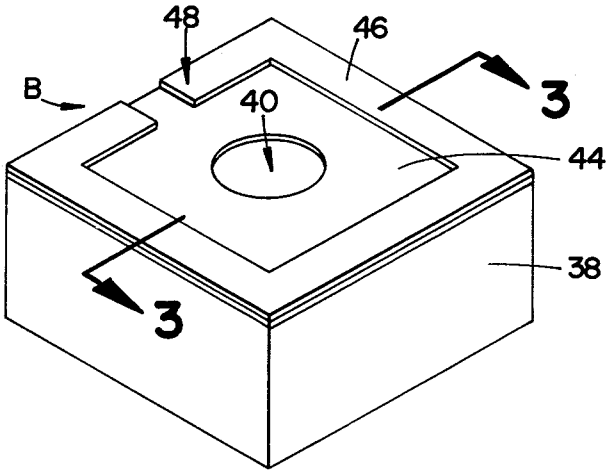
FIG. 2 is a perspective view of an elastomeric workholder of the abrading machine of FIG. 1.
Figure 3:
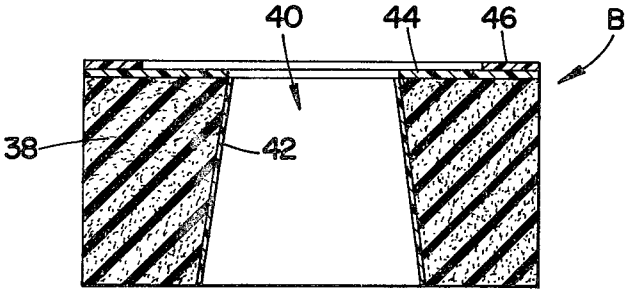
FIG. 3 is a sectional view through section line 3—3 of the workholder of FIG. 2.

Referring now to FIGS. 2 and 3, the workholder B is fashioned of a resilient elastomeric material 38, such as foamed polyurethane resin or the like, which conforms under pressure to the shape of the workpieces to be abraded. The workholder has an exterior dimension adjacent its lower surface to be securely and frictionally received in the cutout area 16. The workholder has a tapered central aperture 40 which is dimensioned to conform at its lower end to the work surface aperture 14. The workholder aperture 40 may be circular, square, rectangular, or any desired cross section. A protective layer of plastic or silicone material 42 surrounds the workholder aperture 40 to protect the resilient material from the abrasive grit. On the top surface of the workholder, a recess receives and holds a mask structure securely in position. The recess is defined at its lower surface by a first plastic layer 44 which is adhesively bonded to the foamed material 38 and by a peripheral edge formed by a second plastic layer 46 which is adhesively bonded to the first layer 44. The peripheal edge is shaped to conform to the outer periphery of the mask and may include a key or notch arrangement 48 for assuring that the mask is properly oriented. The mask is a flexible plastic or metallic sheet which is cut out in the shape of the area to be etched or abraded. Commonly, there is a set of masks each being cut out with the shape of one letter of the alphabet so that the operator can custom select the customer's monogram.

Figure 4:
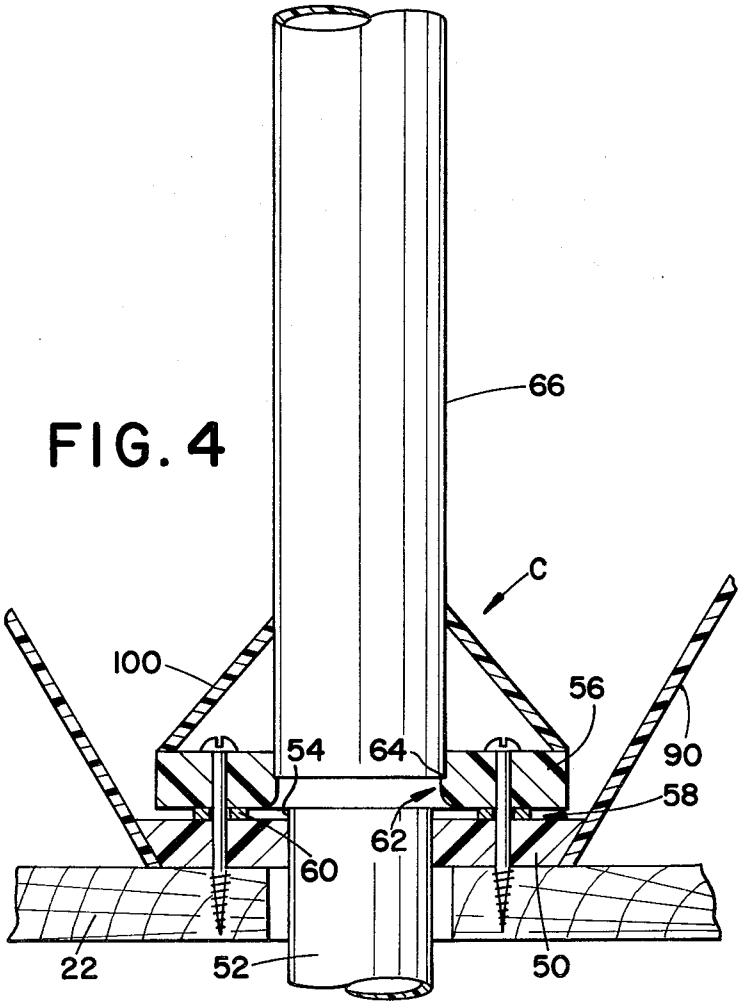
FIG. 4 is a side elevational view in partial section of an abrasive grit entraining means of the abrading apparatus of FIG. 1.

With reference to FIG. 4 and further reference to FIG. 1, the entraining means C includes a venturi-like arrangement in which a pressure drop is caused to draw air and abrasive grit into the air flow. Specifically, the entraining means C includes a base wall 50 which rests on and is secured to the upper supporting shelf 22. Extending through the base 50 is an air inlet tube 52 for introducing the air flow from the air flow supplying means D into the entraining means C. The inlet tube 52 has a short lip or extension 54 which extends above the base wall 50 of the entraining means. Positioned above the base wall 50 is a means 56 for defining a gap 58 peripherally around the lip 54. The peripheral gap defining means 56 is an annular disc which is spaced from the base wall 50 by a plurality of spacers 60. In the preferred embodiment, the spacers 60 are ⅛ inch washers through which pass screws or other means for securing the annular disc 56 to the base wall 50 and the upper supporting shelf 22. In this manner, the peripheral gap 58 is defined between the annular disc 56 and the base wall 50. The height of the peripheral gap 58 and the inlet tube lip 54 are substantially the same, although the height of the inlet tube lip may be greater than the height of the peripheral gap. This prevents the abrasive grit from flowing into the inlet tube 52.

The annular disc 56 has an internal aperture 62 which is larger in cross section than the cross section of the inlet tube lip 54. In the preferred embodiment, the inlet tube 52 is a length of 1¼ inch circular tubing and the directing tube 66 is a length of 1½ inch circular tubing. The cross section of the inlet tube is about 30 percent less than the cross section of the directing tube. This increase in the cross section of the path of the air flow causes a pressure drop which draws additional air and abrasive grit through the peripheral gap 58 into the flow. The annular disc 56 has an annular ledge 64 disposed around the internal aperture 62 for receiving and supporting a directing means or tube 66 for directing the air flow with entrained grit toward the work surface aperture 14 and workholder aperture 40. The inlet tube and the directing tube are vertically disposed in alignment with the work surface and workholder apertures. Although the cross section of the work surface aperture 14, the workholder aperture 40, the inlet tube 52, the annular disc 56, the internal aperture 62, and the delivering tube 66 are all illustrated as circular, other cross sections, such as square, hexagonal, oval, or the like, are contemplated for some or all of them.

The inlet tube lip 54 is substantially unrestricted. That is, the diameter of the inlet tube 52 is substantially constant throughout its length. This eliminates any pressure reservoir such as would be present if a fine nozzle closed the top edge of the inlet tube lip 54. This lack of a pressure reservoir enables the air flow to be started and stopped quickly. This is particularly significant because the apparatus is commonly activated for about 10 second durations. Alternately, a flow restrictor such as a tapered extension, not shown, may be disposed on the top edge of the inlet lip 54 to decrease the cross section and increase the pressure differential. However, the opening in the restrictor should be sufficiently large that the air flow from the inlet tube 52 stops quickly when the air flow supplying means is deactuated.

Figure 5:
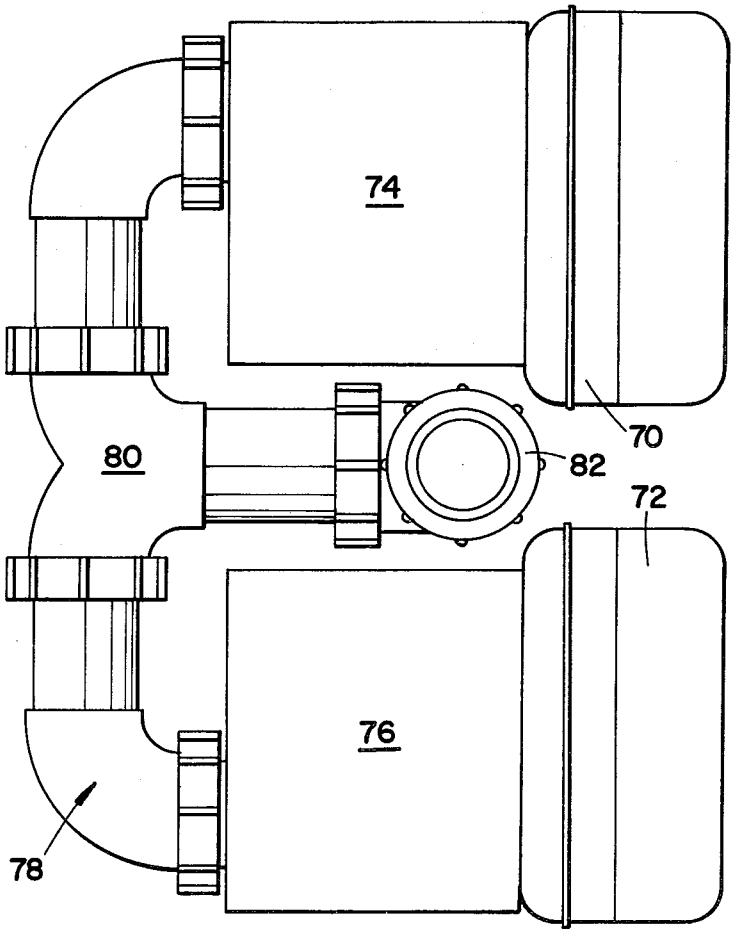
FIG. 5 is a top view of an air flow supplying means of the abrading apparatus of FIG. 1.

With particular reference to FIG. 5 and continuing reference to FIG. 1, the air flow supplying means D includes a turbine-type air impelling means for producing the flow of air. The air impelling means includes a first motor-impeller 70 and a second motor-impeller 72 which draw air from the cabinet A and impel it into a pair of distribution boxes 74 and 76. In the preferred embodiment, the motor-impellers are vacuum cleaner motors, such as LAMB, model 115750 electric motors from Ametek, Inc. of Kent, Ohio. A tubing means 78 connects the distribution boxes with the inlet tube 52. The tubing means includes a Y coupling 80 and an elbow or trap 82 for trapping grit which may fall into the inlet tube when the air flow is terminated. When the air flow supplying means is next actuated, any grit in the trap 82 is blown through the entraining means and out the directing tube.

With continuing reference to FIG. 1, the grit collecting means E includes a channelling element 90 for channelling collected abrasive grit to the entraining means C. The channelling element 90, such as truncated cone or other tapered element, diverges upward from the upper supporting shelf 22 and the base wall 50 terminating at an upper edge with an annular lip 92. Surrounding the work surface aperture 14 along the undersurface of the work surface 12 is an annular shield 94 which terminates in an annular lip 96 of substantially the same diameter as the annular lip 92. Extending between the annular lips 92 and 96 is a cylindrical filter 98. The filter 98 allows the air to flow easily into or out of the grit collecting means E while prohibiting the collected abrasive grit from escaping. In the preferred embodiment, the filter 98 is a woven fabric, although knit or nonwoven fabrics, random fiber, mesh, and other filter materials which are sufficiently fine to trap at least a 60 weight silicon carbide abrasive grit are contemplated. A tapered deflector in the form of a truncated conical section 100 extends between the edge of the annular disc 56 and the directing tube 66. The tapered deflector assists in channelling the abrasive grit to the entraining means by inhibiting it from collecting on the annular disc 56.

Initially, the operator deposits 60 weight silicon carbide abrasive grit in the grit collecting means. A quantity of grit is used to form a reservoir. The quantity is sufficiently great that the reservoir is not quite emptied before rebounding grit has returned, but not so great that the air flow to the peripheral gap 58 is impaired. About a third or a cup of grit, which brings the depth of the grit reservoir about halfway up the annular disc 56, has been found to be satisfactory. Once the grit is added, only the very small amount which escapes from the closed system is replaced. To etch a piece of glassware, the operator selects and places the mask of a letter or design to be etched in the mask receiving recess of the workholder B. The operator places the piece of glassware against the guide means 18 such that the area to be etched is accurately positioned over the central aperture 40 of the mask and applies sufficient downward pressure to cause the workholder and mask to conform to the shape of the glassware. Depressing the foot switch 30 actuates the air supply means for ten seconds or other appropriate duration for the abrasive grit to impact the glassware. When the timer 32 deactuates the motor-impellers 70 and 72, the operator continues to hold the glassware stationary until the motor-impellers have coasted to a stop. This insures that abrasive grit will not escape from the closed system through the work surface aperture 14. Optionally, the motor-impellers 70 and 72 may be equipped with anti-coast circuitry which applies a reverse polarity potential to the motors to stop their rotation immediately upon deactuation. If the monogram is to consist of more than one letter, the operator replaces the mask with the next letter of the monogram and repeats the above operation.

The invention has been described with respect to the preferred embodiment. Obviously modifications and alterations will occur to others upon reading and understanding this specification. It is intended that all such modifications and alterations be included insofar as they come within the scope of the appended claims or the equivalents thereof.

Having now described a preferred embodiment of our invention, we now claim our inventive contribution to be:

1. An abrading apparatus for abrading workpieces with abrasive grit, the apparatus comprising:

a workholder for holding a workpiece to be abraded, the workholder having an aperture which is adapted to pass abrasive grit to impinge on a selected region of the held workpiece;

entraining means for entraining abrasive grit in a flow of air, the entraining means including:

a base, an air inlet tube extending through the base and terminating in a lip having a preselected vertical extension above the base, an annular disc disposed proximate to the base for defining a generally horizontal, peripheral gap annularly around the inlet tube and adjacent the base, the peripheral gap being disposed between the base and the annular disc, the peripheral gap having a preselected vertical width which is substantially the same as the inlet tube lip vertical extension above the base, a directing tube of substantially unrestricted internal cross section extending vertically from adjacent and aligned with the inlet tube lip to adjacent and aligned with the workholder aperture for directing the air flow with entrained grit from adjacent the inlet tube lip and the peripheral gap toward the workholder aperture;

air flow supplying means operatively connected with the air inlet tube for supplying the air flow thereto; and, grit collecting means for collecting grit rebounding from the workpiece held in the workholder, the grit collecting means being disposed adjacent the workholder and being operatively connected with the entraining means to return collected grit to the base to be drawn through the peripheral gap.

2. The apparatus as set forth in claim 1 wherein the vertical extension of the lip and the vertical width of the peripheral gap are both substantially $\frac{1}{8}''$.

3. The apparatus as set forth in claim 1 further including a plurality of spacers disposed between the base and the annular disc.

4. The apparatus as set forth in claim 1 wherein the annular disc includes an internal aperture surrounded by an annular ledge for supporting the directing means.

5. The apparatus as set forth in claim 4 wherein the directing means includes a linear tube disposed on the annular ledge and longitudinally aligned with the workholder aperture.

6. The apparatus as set forth in claim 5 further including a tapered grit deflector extending between the periphery of the directing tube and the periphery of the annular disc.

7. The apparatus as set forth in claim 1 wherein the grit collecting means includes:

a truncated tapered element which surrounds the entraining means and tapers outward from the base wall, whereby the tapered element channels the returning grit towards the peripheral gap, and a filter extending from the tapered element toward the workholder and surrounding the directing tube.

8. An abrading apparatus for abrading workpieces with abrasive grit, the apparatus comprising:

a workholder for holding a workpiece to be abraded, the workholder having an aperture which is adapted to pass abrasive grit to impinge on a selected region of the held workpiece;

entraining means for entraining abrasive grit in a flow of air, the entraining means including:

a base, an air inlet tube extending through the base and terminating in a lip having a preselected vertical extension above the base, an annular disc disposed proximate the base for defining a horizontal peripheral gap of preselected width therebetween, the annular disc defining an internal aperture surrounded by an annular ledge, the cross-sectional area of the inlet tube being less than the cross-sectional area of the internal aperture and the inlet tube vertical extension above the base being substantially the same as the peripheral gap width, whereby the difference in cross-sectional area between the inlet tube and internal aperture permits abrasive grit to pass there between, a directing tube of substantially unrestricted internal cross section being mounted in the annular disc annular ledge adjacent the inlet tube lip and extending vertically therefrom and being aligned with the workholder aperture for directing the air flow with entrained grit from adjacent the inlet tube lip and the peripheral gap toward the workholder aperture;

air flow supplying means operatively connected with the air inlet tube for supplying the air flow thereto; and, grit collecting means for collecting grit rebounding from the workpiece held in the workholder, the grit collecting means being disposed adjacent the workholder and being operatively connected with the entraining means to return collected grit to the base to be drawn through the peripheral gap.

9. The apparatus as set forth in claim 8 wherein the cross-sectional area of the inlet tube is about 30 percent less than the cross-sectional area of the internal aperture.

10. The apparatus as set forth in claim 8 wherein the inlet tube and its lip have a constant, untapered cross-sectional area.

11. An abrading apparatus for abrading a workpiece having one of a variety of surface contours with abrasive grit, the apparatus comprising:

a workholder for holding a workpiece to be abraded, the workholder including:

a workholder body of foamed elastomeric material which conforms under pressure to the surface contour of the workpiece to be abraded, the workholder body defining a workholder aperture generally centrally therethrough for passing abrasive grit to impinge on the workpiece, a protective plastic layer operatively connected with the workholder body lining the workpiece aperture to protect the foamed elastomeric material which defines the aperture from abrasion;

a first layer of material on a workpiece holder top surface and a peripheral edge around the periphery of the top surface whereby a mask receiving recess is defined;

entraining means for entraining abrasive grit in a flow of air, the entraining means including a directing means aligned with the workholder aperture for directing the air flow with entrained grit from the entraining means toward the workholder aperture;

air flow supplying means operatively connected with the entraining means for supplying the air flow thereto; and grit collecting means for collecting grit rebounding from the workpiece held in the workholder and being operatively connected with the entraining means to return collected grit thereto to be reentrained.

12. An abrasive grit etching apparatus comprising:

a cabinet structure including a generally horizontal work surface, the work surface having an aperture therethrough and a recessed cutout area around the work surface aperture, an upper supporting shelf disposed generally horizontally below the work surface, a lower supporting shelf disposed generally horizontally below the upper supporting shelf, and a shield having a substantially transparent portion disposed above the work surface;

a workholder frictionally received in the work surface cutout area, the workholder having an aperture aligned with the work surface aperture;

an entraining means for entraining abrasive grit in a flow of air, the entraining means being supported by the upper supporting shelf substantially in alignment with the work surface aperture and the workholder aperture;

a linear directing tube of substantially unrestricted interior cross section operatively connected with the entraining means and longitudinally aligned with the work surface aperture and the workholder aperture for directing the air flow with entrained grit from the entraining means toward the workholder;

air flow supplying means for supplying the air flow to the entraining means, the air flow supplying means being supported by the lower supporting shelf; and grit collecting means extending generally between the work surface and the upper support shelf for collecting rebounding grit and returning it to the entraining means to be reentrained.

13. The etching apparatus as set forth in claim 12 further including guide means disposed on the work surface adjacent the workholder for assisting in positioning a workpiece accurately on the workholder.

14. The etching apparatus as set forth in claim 12 further including a foot switch mounted in the cabinet structure for actuating the air flow supplying means.

15. The etching apparatus as set forth in claim 14 further including a timer operatively connected with the foot switch for controlling the duration for which the air flow supplying means is actuated.

* * * * *